US005707260A

United States Patent [19]

Yanase

[11] Patent Number: 5,707,260

[45] Date of Patent: Jan. 13, 1998

[54] CONNECTION TERMINAL CHAIN AND METHOD OF PRODUCTION THEREOF

[75] Inventor: Takeshi Yanase, Kosai, Japan

[73] Assignee: Yazaki Corporation, Tokyo, Japan

[21] Appl. No.: 544,104

[22] Filed: Oct. 17, 1995

[30] Foreign Application Priority Data

Oct. 27, 1994 [JP] Japan ..... 6-263509

[51] Int. Cl.[6] ..... H01R 13/02

[52] U.S. Cl. ..... 439/885; 439/852; 29/884

[58] Field of Search ..... 439/885, 852; 29/882, 874, 884

[56] References Cited

U.S. PATENT DOCUMENTS

| | | | |
|---|---|---|---|
| 4,076,369 | 2/1978 | Ostapovich | 439/852 |
| 4,238,140 | 12/1980 | Cairns et al. | 439/595 |
| 4,712,299 | 12/1987 | Loewen et al. | 439/885 |

FOREIGN PATENT DOCUMENTS 54-71385 6/1979 Japan .

*Primary Examiner*—Neil Abrams

*Attorney, Agent, or Firm*—Armstrong, Westerman, Hattori, McLeland & Naughton

[57] ABSTRACT

A terminal chain includes box-shaped terminal-connecting portions (1, 1', 1"), each being rectangular in cross-section and defined by two major side walls (1*a*1 and 1*a*2, 1*a*1' and 1*a*2', 1*a*1" and 1*a*2") and two minor side walls (1*b*1 and 1*b*2, 1*b*1' and 1*b*2', 1*b*1" and 1*b*2") wherein the major side walls (1*a*1 and 1*a*2, 1*a*1' and 1*a*2', 1*a*1" and 1*a*2") are greater in width than the minor side walls (1*b*1 and 1*b*2, 1*b*1' and 1*b*2', 1*b*1" and 1*b*2"). The terminal chain also includes a connecting strip (2) to which the terminal-connecting portions (1, 1', 1") are connected in the form of a chain. Each terminal-connecting portion (1, 1', 1") is connected to the connecting strip (2) via a connecting portion (1*c*, 1*c*', 1*c*") which extends from one of the two minor side walls (1*b*1 and 1*b*2, 1*b*1' and 1*b*2', 1*b*1" and 1*b*2") of the corresponding terminal connecting portion (1, 1', 1"). The terminal chain is formed by folding a development (M) punched out of an electrically-conductive metal plate. The terminal chain can be made small-sized and has a unified direction of fitting with mating terminals which leads to improved operability at the time of fitting with mating terminals.

20 Claims, 4 Drawing Sheets

CONNECTION TERMINAL CHAIN AND METHOD OF PRODUCTION THEREOF

BACKGROUND OF THE INVENTION

1. Field of the Invention

This invention relates to a connection terminal chain having box-shaped terminal-connecting portions for receiving mating terminals and a method of production thereof.

2. Description of the Related Art

A plurality of fuse terminals are conventionally provided in a fuse box used in electric wiring of an automobile or the like. Of these fuse terminals, between those connected to a common power circuit is connected a short bar through riveting or the like. Under such circumstances, it has been proposed to use, in place of the short bar, a terminal chain in which terminals are in advance connected with each other by a connecting strip.

The terminal chain is produced as follows: A development is punched out of a metal band by a press machine, in which a plurality of flatly-developed terminals are connected in the form of a chain by a connecting strip; the development is subjected to folding; and the connecting strip of the folded development is cut at every two terminals if a two-terminal chain is desired.

As a means to adjust the distance between neighboring terminals connected with a connecting strip, it is proposed for example in Japanese Patent Application Laid-Open Specification No. Sho 54-71385 to bend the connecting strip between terminals a and form a recessed portion c as shown in FIG. 5 so that the length of the connecting strip b is shortened.

The adjustment means as mentioned above is effective with a terminal chain of female terminals as shown in FIG. 5. However, in the case of a terminal chain with box-shaped terminal-connecting portions d as shown in FIG. 6, since the terminal-connecting portions d' in their developed state occupy a large space as shown in FIG. 7, the distance between neighboring terminal-connecting portions d after completion of folding becomes increased, resulting in a longer connecting strip b' required. As a result, if the connecting strip b' is bent to adjust the distance between neighboring terminal-connecting portions d, the connecting strip b' is extended largely from between the terminal-connecting portions d as shown in FIG. 8, thereby interfering with other electric parts or forming an obstacle to electric wiring.

If the connecting strip b' is, to prevent its protrusion, bent in the direction of major side walls of the box-shaped terminal-connecting portions d as shown in FIG. 9, the neighboring terminal-connecting portions d come to face in opposite directions, with the result that the electric contact pieces e inside the terminal-connecting portions d are also positioned opposite. Consequently, to cope with this, their mating terminals must be directed opposite, resulting in the part-designing and the fitting work complicated.

SUMMARY OF THE INVENTION

This invention has been accomplished to overcome the above drawbacks and an object of this invention is to provide a terminal chain which eliminates the protrusion of the connecting strip on adjusting the distance between terminals, is capable of being small-sized, has a unified direction of fitting with mating terminals and has a good operability at the time of fitting with mating terminals. It is another object of this invention to provide a method of producing such terminal chain.

In order to attain the objects, according to an aspect of this invention, there is provided a connection terminal chain comprising: two or more terminal-connecting portions each box-shaped and rectangular in cross section, defined by two major and two minor side walls; a connecting strip to which the terminal-connecting portions are connected in the form of a chain; and a connecting portion extended from one of the two minor side walls of each terminal-connecting portion, through which a respective one of the terminal-connecting portions is integrally connected to the connecting strip.

According to another aspect of this invention, there is provided a method of producing a connection terminal chain comprising the steps of:

punching a development out of an electrically-conductive metal plate, said development including a plurality of flatly-developed terminal-connecting portions each with two major and two minor side walls, a connecting strip to which said terminal-connecting portions are connected in the form of a chain, each through a connecting portion extended from one of said two minor side walls of each terminal-connecting portion;

folding said development to form box-shaped terminal-connecting portions each rectangular in cross section; and cutting said connecting strip at predetermined positions.

Since in the terminal chain of this invention each terminal-connecting portion is integrally connected to the connecting strip via a connecting portion extended from one of the minor side walls, the connecting strip is bent to lie parallel to major side walls of the related terminal-connecting portions on adjusting the distance between neighboring terminal-connecting portions. As a result, the portion of the bent connecting strip that extends from between the terminal-connecting portions is small in length, excluding the possibility that the connecting strip forms an obstacle to the installation of the part and making it possible to downsize the terminal. Further, since neighboring terminal connecting portions are orientated in one direction, the fitting with mating terminals is advantageously facilitated, leading to wider uses.

In addition, since the connecting strip is easily bent by a simple bending process to optionally adjust the distance between neighboring terminal-connecting portions, an improvement is made in the productivity at the working step.

The above and other objects, features and advantages of this invention will become apparent from the following description and the appended claims, taken in conjunction with the accompanying drawings.

DETAILED DESCRIPTION OF THE PREFERRED EMBODIMENTS

Figure 1:
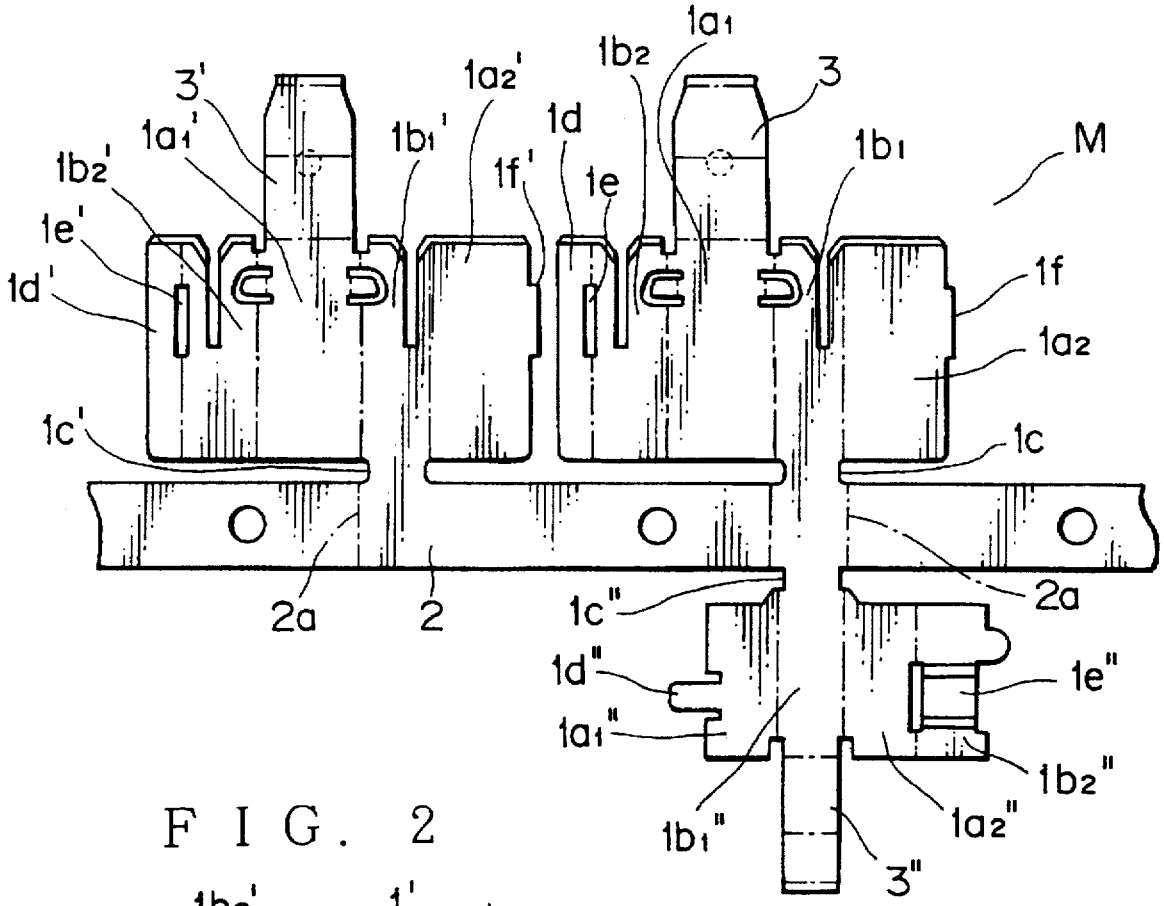
FIG. 1 is a plan view of a development for forming a terminal chain according to an embodiment of this invention.
Figure 2:
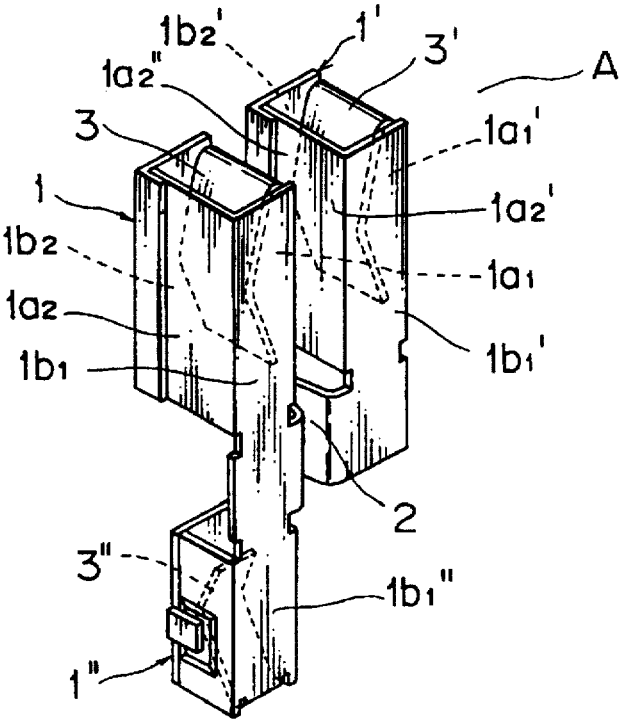
FIG. 2 is a perspective view of the two-terminal chain formed by folding the development of FIG. 1.
Figure 3:
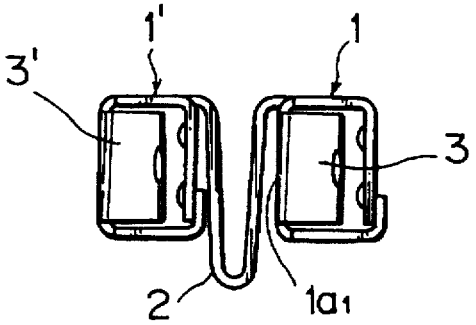
FIG. 3 is a plan view of the connecting strip of the terminal chain of FIG. 2, shown bent.

Referring to FIGS. 1 and 2, a connection terminal chain A according to an embodiment of this invention is formed by folding an electrically-conductive metal plate and comprises box-shaped terminal-connecting portions 1, 1', 1" each rectangular in cross section. The portions 1 and 1' are connected with each other via a bent connecting strip 2 (FIG. 3). The terminal-connecting portion 1" is located below the terminal-connecting portion 1 and connected to the connecting strip 2 above.

The terminal-connecting portion 1 is provided in a box-like shape having a rectangular cross section and defined by opposed major side walls 1*a*1, 1*a*2 and minor side walls 1*b*1; 1*b*2. The terminal-connecting portion 1' is likewise provided in a box-like shape having a rectangular cross section and defined by major side walls 1*a*1', 1*a*2' and minor side walls 1*b*1', 1*b*2' An extension from one of the major side walls 1*a*1 of the terminal-connecting portion 1 is folded into the terminal-connecting portion 1 to provide an electric contact piece 3 through which electrical connection with a mating terminal is made. An extension from one of the major side walls 1*a*1' of the terminal-connecting portion 1' is likewise folded to provide an electric contact piece 3'. An extension from one of the minor side walls 1*b*1" is also folded to form an electric contact piece 3" in the terminal-connecting portion 1".

The development M for the formation of the terminal chain A is punched out of an electrically-conductive metal plate with a press machine and has a configuration corresponding to the terminal chain A flatly developed. The terminal-connecting portion 1 in the development M includes major and minor side walls 1*a* and 1*b* alternated with each other and is integrally connected to a connecting strip 2 via a connecting portion 1*c* at the end of one of the minor side walls 1*b*1.

The other of the minor side walls 1*b*2 is along one side thereof formed with a fixing wall 1*d*, which is during folding overlapped with one of the major side walls 1*a*2 such that an engagement flap if at the major side wall 1*a*2 is engaged in an engagement slit 1*e* at the fixing wall 1*d* to provide the box-shaped terminal-connecting portion 1. The same applies to the terminal-connecting portion 1' and its description will be omitted.

The terminal connecting portion 1" in the development M also includes major side walls 1*a*1", 1*a*2" and minor side walls 1*b*1", 1*b*2" alternated and is integrally connected to the connecting strip 2 via the connecting portion 1*c*" at the end of one of the minor side walls 1*b*1". One of the major side walls 1*a*1" is formed with an engagement tongue 1*d*", which is engaged with an engagement portion 1*e*" at the minor side wall 1*b*2" to provide the box-shaped terminal-connecting portion 1".

The development M is folded at the positions indicated by dotted lines in FIG. 1 to form the box-shaped terminal connecting portions 1, 1' and 1", followed by cutting the connecting strip 2 at cutting portions 2*a* on the outside of the connecting portions 1*c*, 1*c*' to provide the two-terminal chain A as shown in FIG. 2.

The distance between the terminal-connecting portions 1 and 1' of the terminal chain A is easily adjusted by making a change in the degree to which the connecting strip 2 is bent. Since the terminal-connecting portions 1 and 1' are connected to the connecting strip 2 via the respective connecting portions 1*c* and 1*c*' extending from their minor side walls 1*b*1 and 1*b*1', the electric contact pieces inside the respective terminal-connecting portions 1, 1' are, when the connecting strip 2 is bent, orientated in one direction as shown in FIG. 3 to advantageously facilitate connection with mating terminals. Further, the portion of the connecting strip 2 extended beyond the major side wall 1*a*1 on bending the connecting strip 2 is small in length, leading to the downsizing of the terminal chain as a part.

Figure 4:
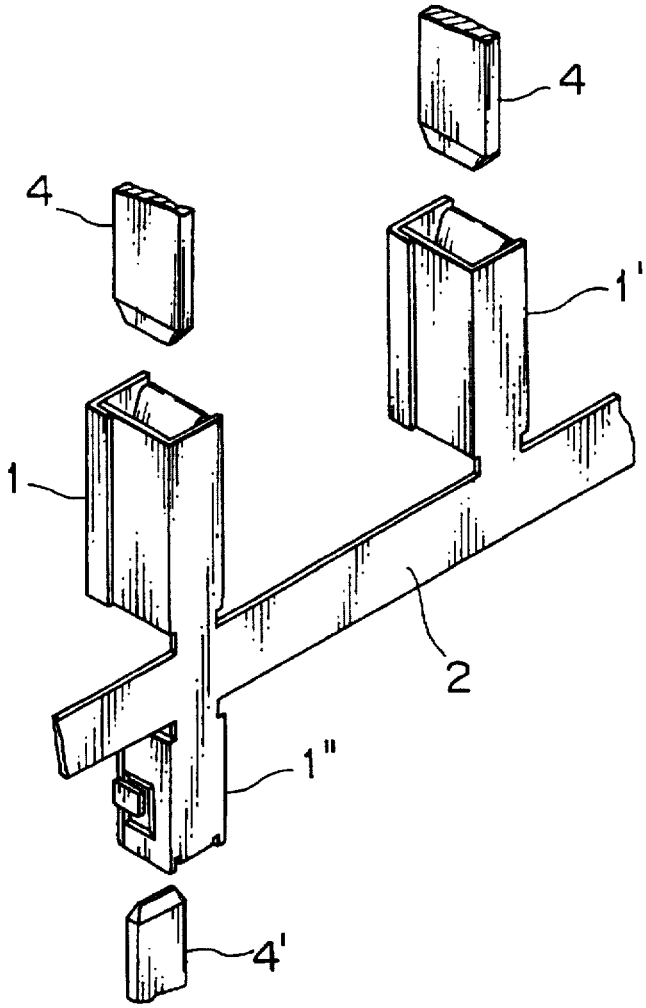
FIG. 4 is an explanatory view showing the directions of the mating terminals fitted with the terminal chain of FIG. 2.
Figure 5:
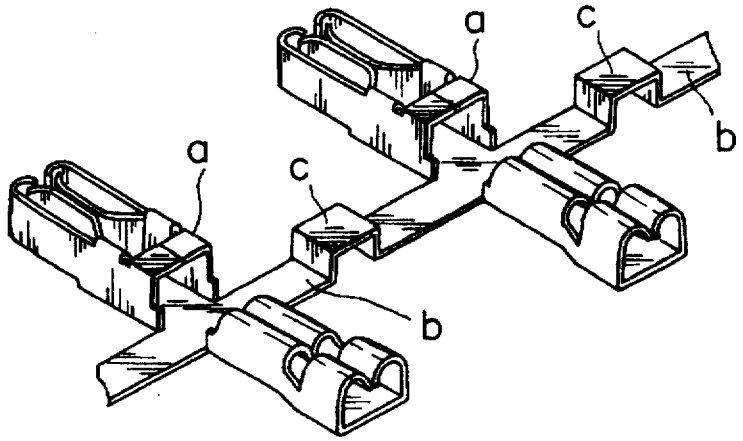
FIG. 5 PRIOR ART
FIG. 5 is a perspective view of a conventional terminal chain.
Figure 6:
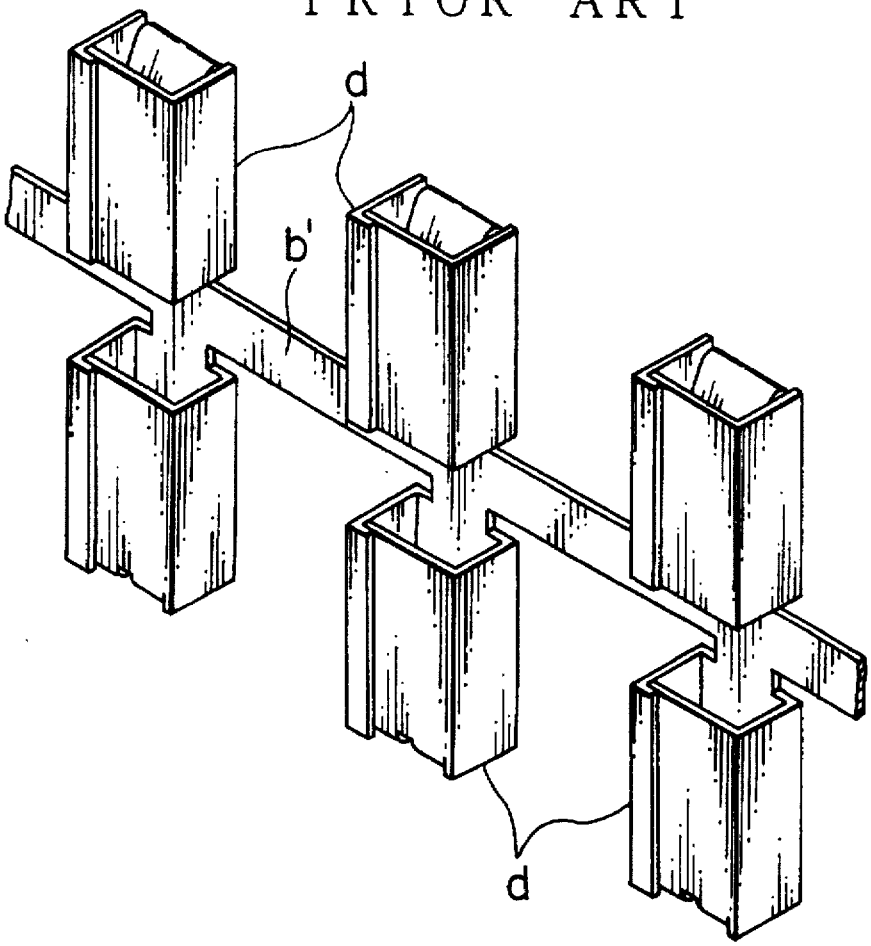
FIG. 6 PRIOR ART
FIG. 6 is a perspective view of a conventional terminal chain with box-shaped terminal connecting portions.
Figure 8:
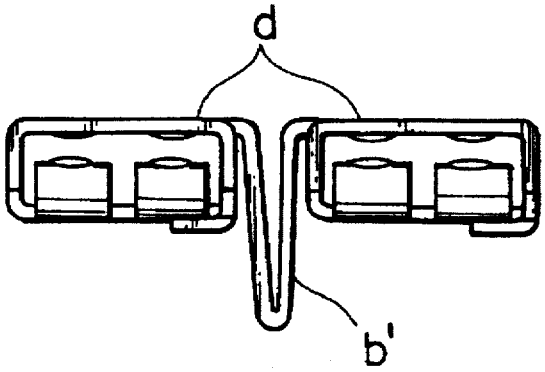
FIG. 8 PRIOR ART
FIG. 8 is a plan view of the connecting strip of the terminal chain of FIG. 6, shown bent.
Figure 7:
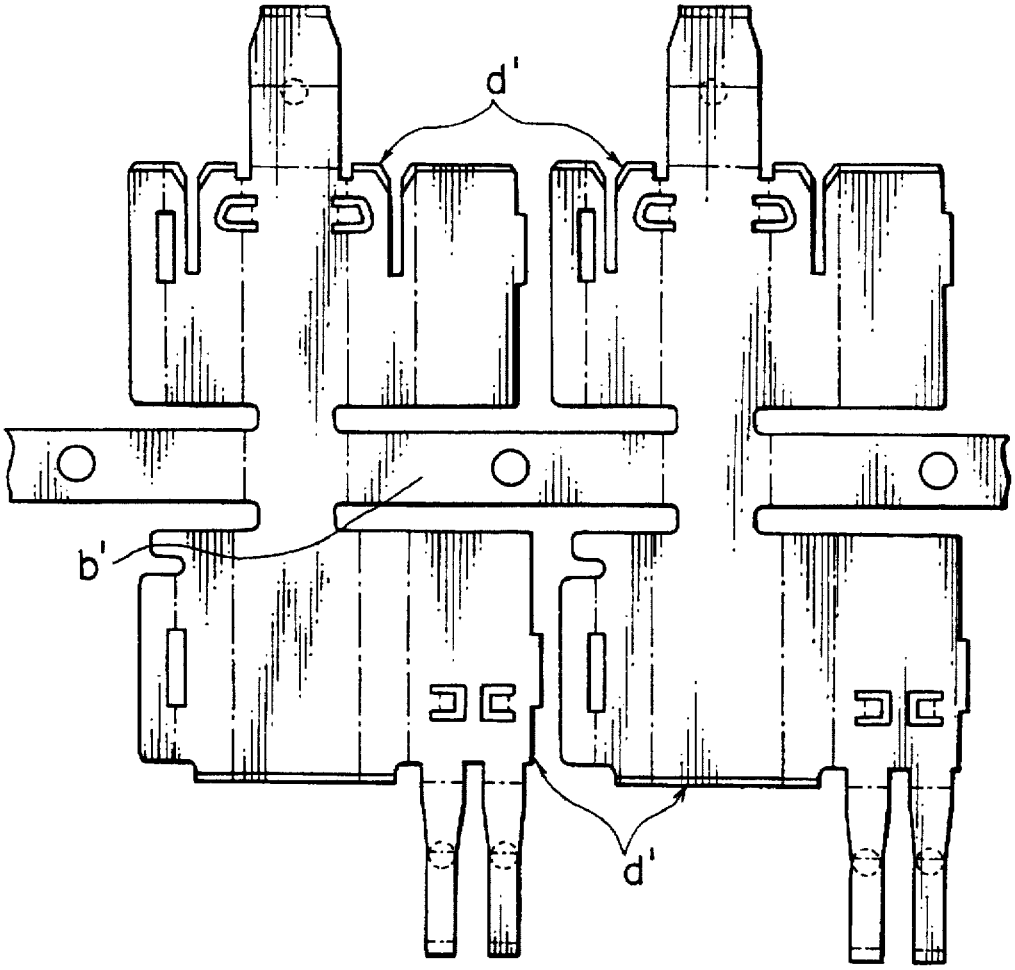
FIG. 7 PRIOR ART
FIG. 7 is a plan view of a development of the terminal chain of FIG. 8.
Figure 9:
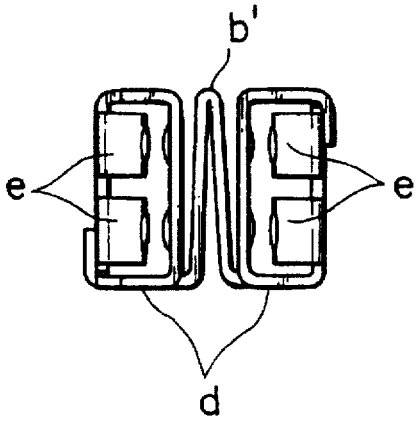
FIG. 9 PRIOR ART
FIG. 9 is an explanatory view showing the directions of neighboring terminal-connecting portions of the terminal chain of FIG. 6.

The terminal connecting portions 1, 1' and the terminal connecting portion 1" of the terminal chain A, as shown in FIG. 4, are directed such that they receive mating male terminals 4 and 4' which are different in direction from each other by 90°. The terminal connecting portion 1", however, may have the same structure as the terminal connecting portions 1, 1' so that it receives a mating male terminal orientated in the same direction as the male terminals 4.

While in the above example description is made of a two-terminal chain A, it is also possible to provide a three- or more terminal chain by optionally selecting the positions where the connecting strip 2 is cut to which terminal connecting portions are connected in a predetermined spaced relationship from each other.

The advantages of this invention may be summarized as follows. Since in the terminal chain of this invention each connecting terminal is integrally connected to the connecting strip via a connecting portion extended from the related minor side wall, the portion of the bent connecting strip extending from between the terminal connecting portions is small in length, excluding the possibility that the connecting strip becomes an obstacle to the installation thereof and also making it possible to downsize the terminal. In addition, since neighboring terminal-connecting portions are orientated in one direction, the fitting with mating terminals is advantageously facilitated, leading to a wider application of the terminal chain.

Further, since the connecting strip is easily bent by a simple bending process to optionally adjust the distance between neighboring terminal connecting portions, an improvement is made in the productivity at the working step.

What is claimed is:

1. A connection terminal chain comprising:

at least two terminal-connecting portions, each being box-shaped and rectangular in cross section so as to have two major and two minor side walls, wherein said two major side walls are each greater in width than said two minor side walls;

a connecting strip to which said terminal-connecting portions are connected forming a chain, wherein said connecting strip is bent into a V-shaped configuration;

a connecting portion extended from one of said two minor side walls of each of said at least two terminal-connecting portions, through which a respective one of said at least two terminal-connecting portions is integrally connected to said connecting strip; and an electric contact piece extended from any one of said major and minor side walls of each of said at least two terminal-connecting portions, which is bent back into said respective one of said at least two terminal-connecting portions.

2. The connection terminal chain according to claim 1, wherein said electric contact piece has a first bend where said electric contact piece is connected to any one of said major and minor side walls.

3. The connection terminal chain according to claim 2, wherein said electric contact piece has a second bend along a length of said electric contact piece where said electric contact piece is within said terminal-connecting portion.

4. The connection terminal chain according to claim 3, wherein said at least two terminal-connecting portions is three terminal-connecting portions.

5. The connection terminal chain according to claim 4, wherein a first and second terminal-connecting portion of said three terminal-connecting portions are located on one side of said connecting strip and a third terminal-connecting portion of said three terminal-connecting portions is located on an opposite side of said connecting strip.

6. The connection terminal chain according to claim 5, wherein said first and second terminal-connecting portions are identical to each other.

7. The connection terminal chain according to claim 6, wherein said third terminal-connecting portion is slightly different than said first and second terminal-connecting portions.

8. The connection terminal chain according to claim 7, wherein each of said first, second and third terminal-connecting portions have an engagement slit.

9. The connection terminal chain according to claim 8, wherein each of said first and second terminal-connecting portions have an engagement flap so that said engagement flap mates with said engagement slit in order maintain each of said first and second terminal-connecting portions rectangular in cross-section and box-shaped.

10. The connection terminal chain according to claim 9, wherein each of said first, second and third terminal-connecting portions have a fixing wall.

11. The connection terminal chain according to claim 10, wherein each of said fixing walls of each of said first and second terminal-connecting portions overlaps one of said major side walls along an entire length of said major or minor side wall.

12. The connection terminal chain according to claim 11, wherein said fixing wall of said third terminal-connecting portion overlaps any one of said major and minor side walls only along a width of said engagement slit to mate with said engagement slit in order maintain said third terminal-connecting portion rectangular in cross-section and box-shaped.

13. The connection terminal chain according to claim 12, wherein said connecting strip includes cutting portions.

14. The connection terminal chain according to claim 13, wherein said connecting strip includes at least one round hole therethrough.

15. The connection terminal chain according to claim 14, wherein first bend of said electric contact piece is not flush with adjacent said minor side walls because of slits made at each junction of said major and minor side walls.

16. A method of producing a connection terminal chain comprising the steps of:

punching a development out of an electrically-conductive metal plate, said development including at least two flatly-developed terminal-connecting portions, each of said at least two terminal connecting portions having two major and two minor side walls such that said major side walls are greater in width than said minor side walls, a connecting strip to which said at least two terminal-connecting portions are connected forming a chain through a connecting portion extended from any one of said two minor side walls of each of said at least two terminal-connecting portions;

folding said development to form said at least two terminal-connecting portions into a box-shape being rectangular in cross section, wherein said folding step includes bending said connecting strip into a V-shaped configuration; and cutting said connecting strip at predetermined positions.

17. The method of producing a connection terminal chain according to claim 3, wherein said folding step includes first folding an electric contact piece through an angle of slightly less than 180 degrees so that said electric contact piece will be within said terminal-connecting portion when folding is commenced.

18. The method of producing a connection terminal chain according to claim 17, wherein said folding step also includes mating an engaging flap with an engaging slit for a first and second terminal connecting-portion.

19. The method of producing a connection terminal chain according to claim 18, wherein said folding step also includes mating a fixing wall with an engaging slit for a third terminal-connecting portion.

20. A method of producing a connection terminal chain comprising the steps of:

punching a development out of an electrically-conductive metal plate, said development including at least two flatly-developed terminal-connecting portions, each of said at least two terminal connecting portions having two major and two minor side walls such that said major side walls are greater in width than said minor side walls, a connecting strip to which said at least two terminal-connecting portions are connected forming a chain through a connecting portion extended from any one of said two minor side walls of each of said at least two terminal-connecting portions;

folding said development to form said at least two terminal-connecting portions into a box-shape being rectangular in cross section, wherein said folding step includes:

folding an electric contact piece through an angle of slightly less than 180 degrees so that said electric contact piece will be within said terminal-connecting portion when folding is commenced;

mating an engaging flap with an engaging slit for a first and second terminal connecting-portion;

mating a fixing wall with an engaging slit for a third terminal-connecting portion; and bending said connecting strip into a V-shaped configuration; and cutting said connecting strip at predetermined positions.

* * * * *